US010513843B2

(12) United States Patent
Grant

(10) Patent No.: US 10,513,843 B2
(45) Date of Patent: Dec. 24, 2019

(54) DRAINAGE

(71) Applicant: JESANI LIMITED, Auckland (NZ)

(72) Inventor: Hohaia Grant, Auckland (NZ)

(73) Assignee: JESANI LIMITED, Auckland (NZ)

( * ) Notice: Subject to any disclaimer, the term of this patent is extended or adjusted under 35 U.S.C. 154(b) by 0 days.

(21) Appl. No.: 15/749,475

(22) PCT Filed: Jul. 29, 2016

(86) PCT No.: PCT/NZ2016/050119
§ 371 (c)(1),
(2) Date: Jan. 31, 2018

(87) PCT Pub. No.: WO2017/023178
PCT Pub. Date: Feb. 9, 2017

(65) Prior Publication Data

US 2018/0238040 A1 Aug. 23, 2018

(30) Foreign Application Priority Data

Jul. 31, 2015 (NZ) ..... 710656

(51) Int. Cl.
*E03F 5/04* (2006.01)
*E03C 1/22* (2006.01)
*A47K 3/28* (2006.01)

(52) U.S. Cl.
CPC ..... *E03F 5/0407* (2013.01); *A47K 3/28* (2013.01); *E03C 1/22* (2013.01); *E03F 5/0409* (2013.01)

(58) Field of Classification Search
CPC ..... E03F 5/0407; E03F 5/0408; E03F 5/0409; E03C 1/22; E03C 1/26; A47K 3/28; A47K 3/40
(Continued)

(56) References Cited

U.S. PATENT DOCUMENTS 1,809,549 A * 6/1931 Duncan ..... E04D 13/0409 210/163
4,410,839 A 10/1983 Dobkin
(Continued)

FOREIGN PATENT DOCUMENTS

DE 202010002011 9/2010
EP 1577452 9/2005
(Continued)

OTHER PUBLICATIONS

International Search Report dated Jul. 26, 2016.
Written Opinion of the International Search Authority dated Oct. 31, 2016.

*Primary Examiner* — Christopher Upton
(74) *Attorney, Agent, or Firm* — Lowe Graham Jones PLLC

(57) ABSTRACT

A drainage channel is adapted to receive fluid from a floor and drain it to a waste outlet. The channel has a floor portion and sides which fluidly enclose and define the channel. One of the sides has a substantially planar flange extending outwardly, and a second one of the sides has a substantially planar flange extending outwardly or upwardly. A waste aperture in the floor portion allows draining of the fluid from the channel to the waste outlet. A grate is supported from the floor portion and is adjustable in height. The channel can be located within an aperture in a building floor and the outwardly extending flanges can be secured to an upper surface of the floor, with the upwardly extending flanges securable to an upward surface of a channel surrounding wall, such that a drainage channel can be located in the building floor for removal of fluid.

17 Claims, 10 Drawing Sheets

(58) Field of Classification Search
USPC ..... 210/163, 164; 4/286, 292, 613, 679
See application file for complete search history.

(56) References Cited

U.S. PATENT DOCUMENTS

| | | | | |
|---|---|---|---|---|
| 5,687,068 | A | 11/1997 | Jamieson | |
| 2008/0058712 | A1 | 3/2008 | Plahey | |
| 2010/0162481 | A1 | 7/2010 | Erlebach | |
| 2011/0162137 | A1 | 7/2011 | Kik et al. | |
| 2011/0203979 | A1 | 8/2011 | Schlueter | |
| 2012/0037552 | A1* | 2/2012 | Persson | E03F 5/0407 210/163 |
| 2012/0179133 | A1 | 7/2012 | Bedingield | |
| 2013/0318704 | A1* | 12/2013 | Plank | E03F 5/0408 4/613 |
| 2014/0352810 | A1* | 12/2014 | Wedi | E03F 5/0407 137/362 |
| 2014/0352815 | A1* | 12/2014 | Brodey | E03F 5/0407 137/544 |

FOREIGN PATENT DOCUMENTS

| | | | |
|---|---|---|---|
| EP | 1600567 | * | 11/2005 |
| EP | 2184414 | * | 5/2010 |
| EP | 2354341 | * | 2/2011 |
| EP | 2570559 | * | 3/2013 |
| EP | 2184414 | | 10/2013 |
| EP | 2808457 | | 12/2014 |

* cited by examiner

DRAINAGE

PRIORITY CLAIM

This application claims the benefit of New Zealand Patent Cooperation Treaty application number PCT/NZ2016/050119, filed Jul. 29, 2016, which claims benefit to New Zealand application number NZ 710656, filed Jul. 31, 2015, the contents of which are incorporated by reference.

FIELD OF THE INVENTION

The present invention relates to drainage.

In particular, though not solely, the present invention is directed to drainage in a building floor in a wet space, or in a building floor between a wet space and a dry space.

BACKGROUND OF THE INVENTION

When draining fluid from a building floor, for example in a shower, or a bathroom floor a circular drain is often provided in the building floor, which is then connected to a waste outlet to drain the water away.

However increasingly there is a desire for different shaped and look drains.

One solution for an in floor drain is to provide a drain structure and then waterproof the entire resulting cavity. A grate then is located in the resulting drain which is supported on legs off the bottom of the cavity. A disadvantage of this in addition to the full waterproofing needed, and the time taken to craft the channel in place, is the weight of the grate will cause the waterproofing to fail as the legs cut into the waterproofing.

A further disadvantage of existing systems is the requirement to provide differing heights between any mounting flange at the top of the drain to account for differing floor finish thicknesses. This is because only one height of covering is provided and the in floor drain must then be provided with the correct depth to place the top of the covering at the desired level, typically flush, with the surrounding floor surface. This results in more stock of drains that needs to be held to account for a variety of finishes, heights and installed lengths. This is a clear disadvantage as generally all combinations must be provided or kept in stock, with the resulting cost of product, storage and potentially wastage of unused product.

There is also an increasing desire to provide in floor drainage to contain water from spreading, for example water from a bathroom spilling past a door in a hallway, for example that may be carpeted. Such a spill may occur by normal use, or may occur due to a blockage, for example in a sink or bath. It will be understood that such containment may be desirable to prevent damage to the area outside, for example the hallway of the bathroom. There may also be a desire to prevent water damage to areas below for example in a multi-story apartment building or similar. A further desire is present to contain appliances where fluid leakage is a risk. For example to contain leakage from a dishwasher or washing machine, for example in a laundry, or kitchen or similar.

Further, existing solutions that use a premade channel require significant bracing not only around the aperture the channel is mounted in, but also underneath. This underneath bracing must be at a precise depth to correctly support the channel of the desired depth, which in turn is dependent on the floor height, eg tile thickness, chosen. This requires that a chosen tile or floor thickness once chosen, cannot then be changed as this will required the channel depth to be altered as well then as the supporting framing underneath. This mean there cannot be change in flooring specification without significant reworking. Further should, at a later date there be a desire to change the floor finish, eg from a 15 mm thick tile to a 10 mm thick tile, then either the user must suffer having a channel covering that is now 5 mm higher, or must also remove the existing channel and underneath framing and replace them both. Suffering a 5 mm difference, for example, may be acceptable when the channel is against a wall, but will be insufferable if mounted mid floor, as a user will continually catch the cover with their foot, footwear, or cleaning equipment. Additionally if the underneath framing is not reworked for the new height then there is significant risk of failure of the waterproof envelope resulting in highly costly water damage.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved drainage channel or to overcome the above shortcomings or address the above desiderata, or to at least provide the public with a useful choice.

SUMMARY OF THE INVENTION

In a first aspect the present invention may be said to broadly consist in a drainage channel adapted to receive fluid from a building floor and drain it to a waste outlet, comprising or including, an upwardly open channel having a lower most floor portion and about the floor portion are sides to fluidly enclose and define the channel, on an upper most periphery of the channel a first one of the sides has a substantially planar flange extending outwardly therefrom, and on the upper most periphery a second one of the sides has a substantially planar flange extending outwardly or upwardly therefrom, and a waste aperture in the floor portion to allow draining of the fluid from the channel to the waste outlet when fluidly connected thereto, a grate supported from the floor portion via upstands unitary with, and extending from, a lower portion of the grate, the grate is adjusted in height via a height of the upstands to have an upper surface of the grate substantially at a desired height relative an upper surface of a finishing of the building floor, wherein the channel can be substantially located within an aperture in the building floor and the substantially planar flange(s) extending outwardly can be secured to an upper presenting surface of the floor, and the substantially planar flange extending upwardly can be secured to an upward surface of a channel surrounding wall, to hold the drainage channel in place, such that a drainage channel can be located in the building floor for removal of fluid therefrom.

Preferably the drainage channel requires no support from below, it is only secured in place by the planar flanges.

Preferably any necessary waterproofing and floor finishing is located over the top of the planar flanges.

Preferably the waterproofing extends from the planar flanges at least in part down into the channel.

Preferably the drainage channel is formed from a thin walled material, including, but not limited to, a metal sheet folded and formed, or a plastics material, molded or extruded.

Preferably the drainage channel has the planar flanges on at least two or more sides.

Preferably each of the sides of the channel has a planar flange extending therefrom.

Preferably those planar flanges that are adjacent each other and extending outwardly are joined together.

Preferably those planar flanges that are adjacent each other and extending upwardly are joined together.

Preferably those sides adjacent a wall have upwardly extending substantially planar flanges.

Preferably those sides adjacent a building floor have outwardly extending substantially planar flanges.

Preferably the planar flanges are secured to the building floor and walls using penetrative fastenings through the planar flanges and into the floor and walls.

Preferably said channel is located in a building floor in any one or more of the following locations, a shower for draining fluid therefrom, a floor of a bathroom, laundry or kitchen or similar for draining spilled or cleaning fluids therefrom, at or near a threshold between a first area (such as a bathroom, laundry or kitchen and a hallway or similar potential source of fluid) for draining of fluid that may be spilt in that area to prevent that fluid moving into a second area.

Preferably the channel is manufactured in certain standard lengths and is also cut and formed to the length as needed.

Preferably all that is needed to specify the drainage channel for installation is the length that is required of the channel.

Preferably in addition all that is needed to specify the grate is the height of the upper surface of the floor above the floor portion to in turn adjust the height of the upstands.

Preferably the first one of the sides and the second one of the sides are parallel and opposed to each other.

In another aspect the present invention may be said to broadly consist in a method of installing or providing a drainage channel adapted to receive fluid from a building floor and drain it to a waste outlet, comprising or including the steps of, Providing an upwardly open channel having a lower most floor portion and about the floor portion are sides to fluidly enclose and define the channel, on an upper most periphery of the channel a first one of the sides has a substantially planar flange extending outwardly therefrom, and on the upper most periphery a second one of the sides has a substantially planar flange extending outwardly or upwardly therefrom, and a waste aperture in the floor portion to allow draining of the fluid from the channel to the waste outlet when fluidly connected thereto, locating the channel into an aperture in the building floor and securing the planar flanges to an upper presenting surface of the floor, and/or surrounding wall, to hold the drainage channel in place, and the drainage channel requires no support from below, it is only secured in place by the planar flanges, fluidly connecting the waste aperture to a waste outlet of the building, applying waterproofing at least to the building floor over the planar flanges and at least in part down into the channel, laying a building floor finishing at least to an upper periphery of the channel, and locating a grate into the channel, the grate being supported from the floor portion via upstands unitary with, and extending from, a lower portion of the grate, adjusting the grate height via a height of the upstands to have an upper surface of the grate substantially at a desired height relative an upper surface of a finishing of the building floor, such that a drainage channel can be located in the building floor for removal of fluid therefrom to the waste outlet.

Preferably the planar flanges are secured to the building floor and walls using penetrative fastenings through the planar flanges and into the floor and walls.

Preferably a finishing on a surrounding wall extends down past the periphery of the channel.

Preferably said channel is located in a building floor in any one or more of the following locations, a shower for draining fluid therefrom, a floor of a bathroom, laundry or kitchen for draining spilled or cleaning fluids therefrom, at a threshold between a bathroom, laundry or kitchen and a hallway or similar for draining of fluid that may be spilt in the bathroom, laundry or kitchen to prevent that fluid moving into the hallway or similar.

Preferably the method includes the step of sizing a length of the channel to a length of the building floor aperture.

In yet another aspect the present invention may be said to broadly consist in a kit of parts for a drainage channel adapted to receive fluid from a building floor and drain it to a waste outlet, comprising or including, an upwardly open channel having a lower most floor portion and about the floor portion are sides to fluidly enclose and define the channel, on an upper most periphery of the channel a first one of the sides has a substantially planar flange extending outwardly therefrom, and on the upper most periphery a second one of the sides has a substantially planar flange extending outwardly or upwardly therefrom, and a waste aperture in the floor portion to allow draining of the fluid from the channel to the waste outlet when fluidly connected thereto, a grate able to be supported from the floor portion via upstands unitary with, and extending from, a lower portion of the grate, the grate able to be adjusted in height via a height of the upstands to have an upper surface of the grate substantially at a desired height relative an upper surface of a finishing of the building floor, wherein the channel can be substantially located within an aperture in the building floor and the substantially planar flange(s) extending outwardly can be secured to an upper presenting surface of the floor, and the substantially planar flange extending upwardly can be secured to an upward surface of a channel surrounding wall, to hold the drainage channel in place, and the drainage channel requires no support from below, it is only secured in place by the planar flanges, such that a drainage channel can be located in the building floor for removal of fluid therefrom.

Preferably said kit is supplied with penetrative fastenings to secure the substantially planar flanges to a building floor and (if present) a wall.

Preferably the kit is supplied with a sealing gaskets for the waste outlet.

In another aspect the present invention may be said to broadly consist in a drainage channel as described herein with reference to any one or more of the accompanying drawings.

In another aspect the present invention consists in a method of installing or providing a drainage channel as described herein with reference to any one or more of the accompanying drawings.

In another aspect the present invention consists in a kit of parts as described herein with reference to any one or more of the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present, but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

Other aspects of the invention may become apparent from the following description which is given by way of example only and with reference to the accompanying drawings.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Preferred embodiments will now be described with reference to FIGS. 1 through 15. It is to be understood the preferred function of the present invention is to prevent damage due to flow of fluids where they are not desired. For example to ensure fluid in a shower or bathroom drains away, for example by providing a drainage channel within the shower or bathroom, or at least within the designated wet, or waterproofed area. Further the present invention can be used to drain away fluids that result from cleaning, e.g. floor cleaning products that may for example be used in a kitchen or similar. Further the present invention may be used as a safety drain to prevent a fluid that is accidentally spilt or that overflows, from moving into an area where it may contain damage, for example in a laundry near a washing machine or dishwasher, or under or beside a door as a threshold or similar, between one room, for example a bathroom, that water will not damage and that may be the source of the fluid, to another room where it is desired to not have fluid flow, for example a hallway.

Such containment may be a single story building, but also will prove highly desirable when in a multi-story building to contain fluid within a waterproofed area and prevent it migrating to a non-waterproofed area, for example a hallway, where it would otherwise damage the structure, e.g., ceiling or floor, below.

Figure 1:
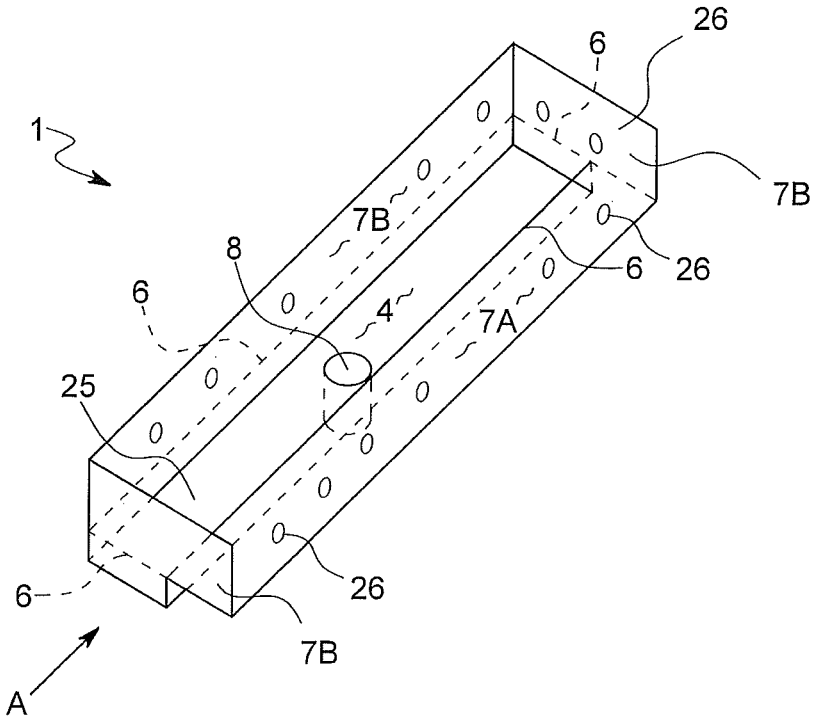
FIG. 1 shows a drainage channel in plan isometric view, the drainage channel being the embodiment for example for use in a shower to remove water.
Figure 2:
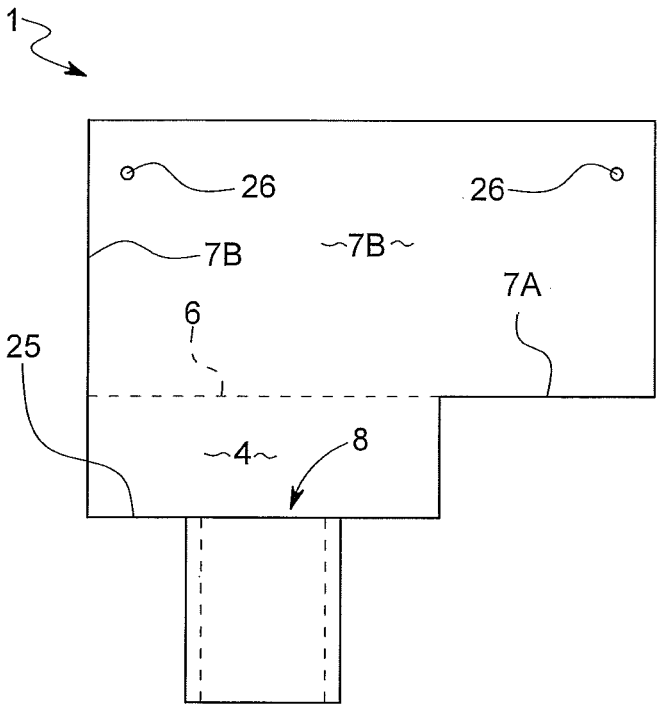
FIG. 2 shows a vertical cross-section through the embodiment of FIG. 1.

A first embodiment of the drainage channel 1 is shown in FIGS. 1 through 4. The drainage channel 1 as shown has a channel 4 that is upwardly open and is defined by a lowermost floor portion 25, and sides 5 that define an uppermost periphery 6 of the channel 4 as shown in FIGS. 1 and 2. Depending from the upper most periphery 6 are substantially planar flanges 7 that extend outwardly 7A and upwardly 7B. As shown in the preferred forms in FIG. 1, those flanges 7 that are adjacent each other are joined, such as the upward planar flanges 7B. The function of these will be described below.

Located in the lowermost point of the channel 4, that is, in the floor portion 25 is a waste aperture 8. This has an extension as a spigot as shown that allows for connection with a waste outlet 3 (see FIG. 3), for example by threaded connection or other known connection, for drainage of fluid to the normal grey water or sewage connection (not shown).

Shown also are pre-made fastener holes 26 to allow for penetrative fasteners. By providing such pre-made holes it is indicated the number and spacing of fasteners that are required to safely and correctly mount the channel to hold the loads that may be applied to it to prevent structural failure, and more importantly to prevent failure of the waterproof membrane or region which the channel forms an integral part of. Alternatively the penetrative fasteners may be ones that are of the self-drilling type and no holes are needed.

In the preferred form the present invention is made from folded steel sheet, for example stainless steel that is folded to form an open channel form and then ends are either folded up or welded into place to form the channel 1. Alternatively the channel 1 may be made from other materials, such as, but not limited to, plastics materials and may be folded or extruded, or molded. In one form the channel may be made in an indefinite length and then cut or formed to size as needed.

Figure 4:
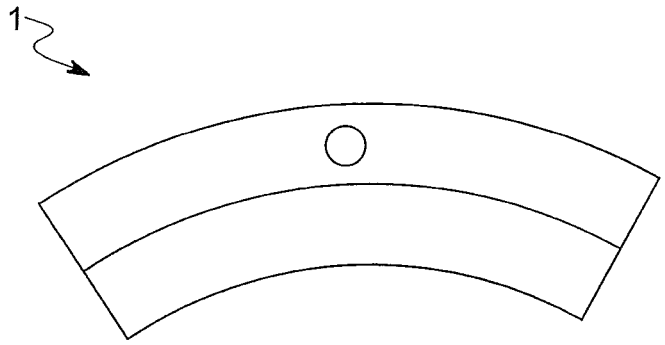
FIG. 4 shows in plan view a curved embodiment of the drainage channel of FIG. 1.

The channel 1 is also not limited to a rectangular form as shown, but may for example be curved as shown in FIG. 4, for example. Such curved form is desirable aesthetically, and also conveys the further secondary advantage of preventing build up or materials, and allowing ease of cleaning.

Figure 3:
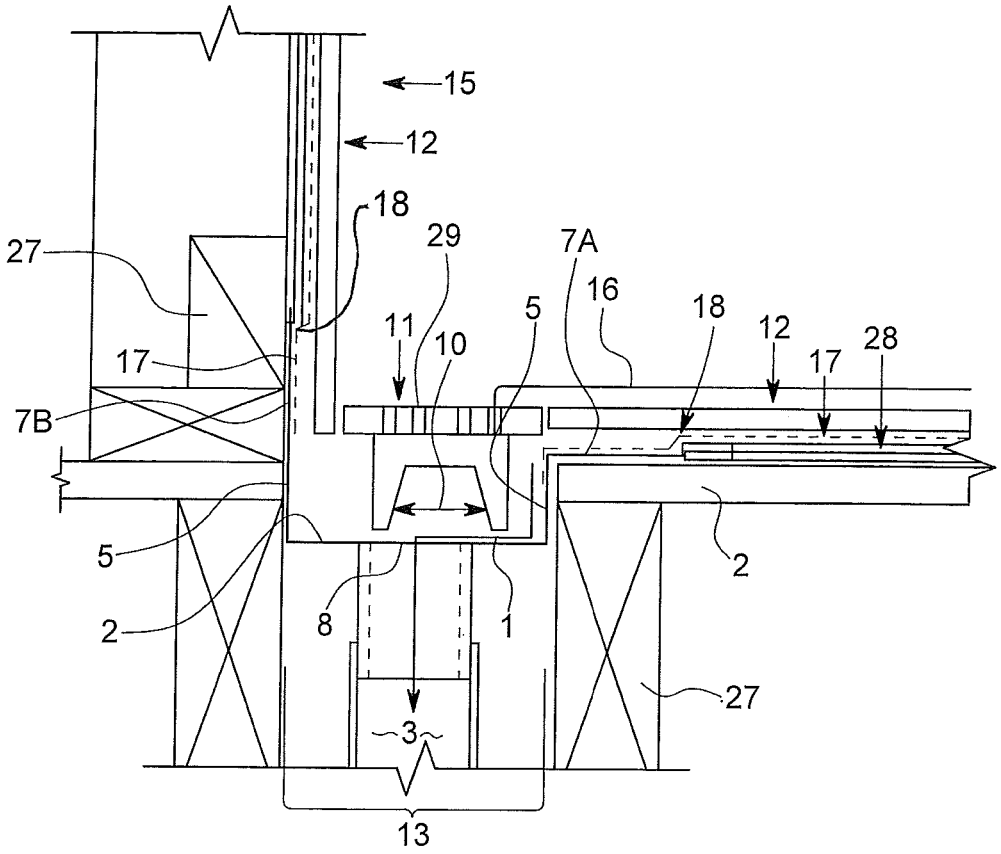
FIG. 3 shows in cross-section detail the installation of the drainage channel of FIG. 1 against a vertical wall.

The general installation of the drainage channel 1 is shown in FIG. 3, in this example the drainage channel is located in a corner of a room along, and against, part of a wall 15. An aperture 13 is shown cut into a building floor 2, along that part of the wall 15. The building floor 2 is supported in the normal way for a building as shown. The channel 1 is lowered into place in the aperture 13.

If desired the installer may add waterproofing, adhesive or sealant to the underside of the planar flanges 7 to seal against for example the sides or other surfaces of the aperture 13.

Penetrative fasteners are then driven through the planar flanges 7 into the substrate below. In the embodiment shown for outward planar flanges 7A the fasteners are driven into the building floor 2 (and framing 27 there under), and for upward flanges 7B then are driven into the surrounding walls 15 (and framing 27 there behind). In the preferred form framing 27 is provided at the periphery of the aperture and behind the wall 15 to support the floor 2 and wall 15, and also to receive the penetrative fastenings from the planar flanges 7. Once secured in this way there is no need for further support for the channel 1 from underneath, the planar flanges and structural rigidity due to its long narrow box form is sufficient to take all in use loading for the channel.

Normally a tiling or similar underlay 28 is be located in place. The installer than can install waterproofing 17 across the floor 2 and over the underlay 28 and outward planar flange 7A and down the wall 15 and upward planar flange 7B as shown. In the preferred form the waterproofing 17 extends at least in part down the sides 5 into the channel 4.

A finishing 12 can then be applied for example tiles or similar. The finishing 12 on the floor extends up to the edge of the channel 4, and on the walls 15 it extends below the lower surface of the floor finishing 12 as shown.

A grate with grate apertures 29 therein is then located in the channel 2. The grate has upstands 10 along its length that rest on the lowermost floor portion 25. The upstands can be adjusted in height, either by a threaded connection, or simply cutting them to length. The desired height is set so the upper surface 11 of the grate is substantially flush with the upper level of the floor finishing 12. The grate may also be able to receive a finish on its upper surface 11 to match or otherwise compliment the floor finishing.

At any point during this procedure, but preferably as the channel 1 is initially located in the aperture 13 the waste outlet 3 is connected to the waste aperture 8.

The result is that fluid, for example water from a shower, can then flow over the floor finishing and down the wall finishing into the channel 1 and then be taken away by the waste aperture 8 to the waste outlet 3. The channel 1 does not need any framing made under it to support it.

Figure 5:
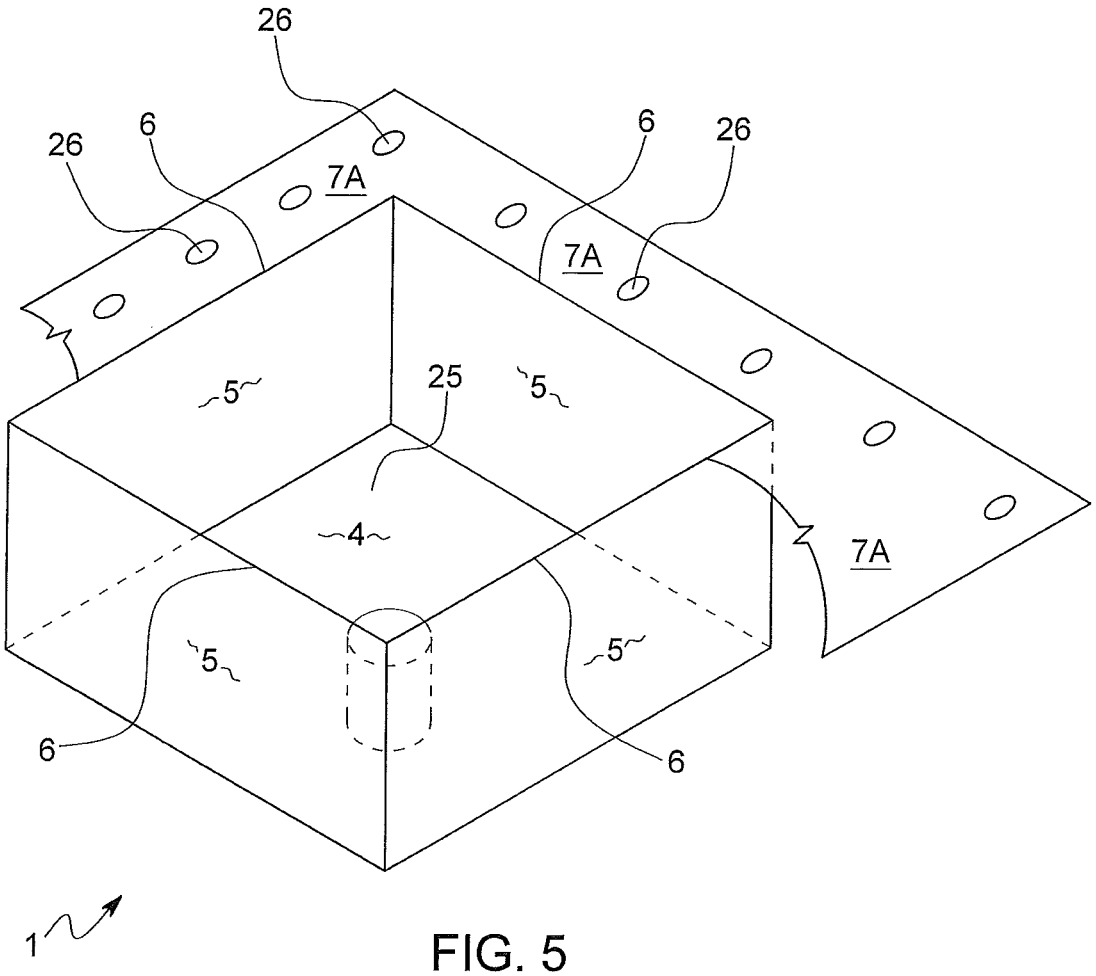
FIG. 5 shows another preferred embodiment as a floor drain in plan isometric view.
Figure 6:
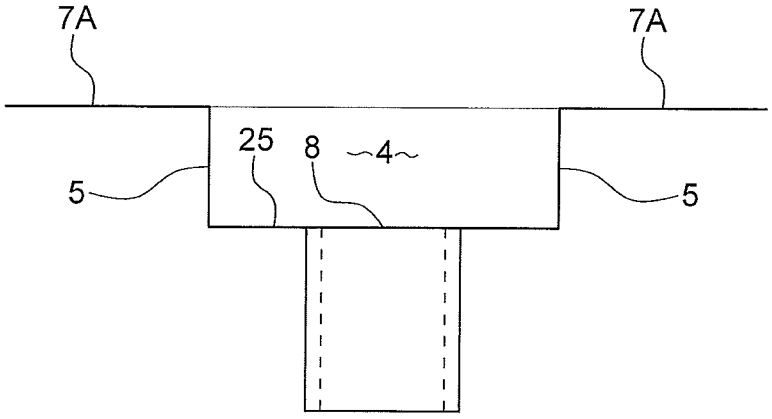
FIG. 6 shows a vertical cross-section through the embodiment of FIG. 5.
Figure 7:
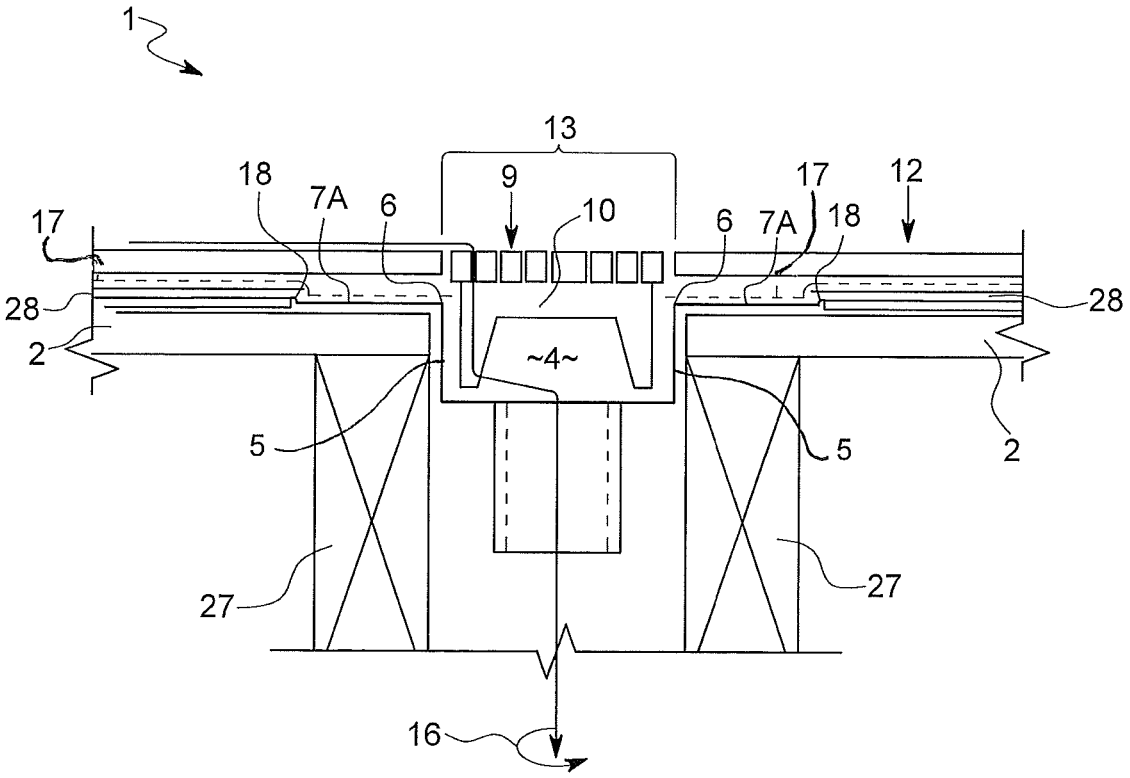
FIG. 7 shows a cross-section of the embodiment of FIG. 5 installed in a floor showing the various floor and support members.

A second embodiment of the drainage channel for in floor draining, for example for spills and cleaning fluids is shown in FIGS. 5 through 7.

The channel 4 has a floor portion 25 surrounded by sides 5 to define a periphery 6 and the channel 4. Extending outwardly from the periphery 6 from each side 5 is an outward planar flange 7A (shown broken away in part for clarity). These planar flanges as they are adjacent are joined. In the preferred form the planar flanges 7A have fastener holes 26.

An installation of the channel 1 is shown in FIG. 7. The channel 1 is installed in a similar manner to that described for the first embodiment and the same integers apply here. The main difference is the channel 1 here as all outward planar flanges 7A, for example at least on two parallel sides, preferably the longer sides, as it is not installed against a wall.

The general installation of the drainage channel 1 is shown in FIG. 7, in this example the drainage channel is located in a floor of a room. An aperture 13 is shown cut into a building floor 2. The building floor 2 is supported in the normal way for a building as shown using framing 27. The channel 1 is lowered into place in the aperture 13. Again no under channel framing support is needed.

If desired the installer may add waterproofing, adhesive or sealant to the underside of the planar flanges 7 to seal against for example the sides or other surfaces of the aperture 13.

Penetrative fasteners are then driven through the planar flanges 7 into the substrate below. In the embodiment shown for outward planar flanges 7A the fasteners are driven into the building floor 2 (and framing 27 there under). In the preferred form framing 27 is provided at the periphery of the aperture to support the floor 2 and wall 15, and also to receive the penetrative fastenings from the planar flanges 7. Once secured in this way there is no need for further support for the channel 1 from underneath, the planar flanges and structural rigidity due to its box form is sufficient to take all in use loading for the channel. In a similar way to the previous embodiment holes may be predrilled for the fasteners in the flanges to indicate the correct number and placement of fasteners to securely hold the channel in place to prevent movement and failure of the waterproof envelope.

Normally a tiling underlay 28 is located in place. The installer than can install waterproofing 17 across the floor 2 and over the underlay 28 and outward planar flange 7A and down the wall 15 and upward planar flange 7B as shown. In the preferred form the waterproofing 17 extends at least in part down the sides 5 into the channel 4.

A finishing 12 can then be applied for example tiles or similar. The finishing 12 on the floor extends up to the edge of the channel 4 as shown.

A grate with grate apertures 29 therein is then located in the channel 2. The grate has upstands 10 along its length that rest on the lowermost floor portion 25. The upstands can be adjusted in height, either by a threaded connection, or simply cutting them to length. The desired length is set so the upper surface 11 of the grate is substantially flush with the upper level of the floor finishing 12.

At any point during this procedure, but preferably as the channel 1 is initially located in the aperture 13 the waste outlet 3 is connected to the waste aperture 8.

The result is that fluid, for example water from a shower, can then flow over the floor finishing and down the wall finishing into the channel 1 and then be taken away by the waste aperture 8 to the waste outlet 3. The channel 1 does not need any framing made under it to support it.

A third embodiment of the drainage channel for preventing fluid moving from a wet area to a dry area, for example at a threshold of a bathroom, laundry or kitchen 20 to a hallway 22 or similar area where fluid may emanate from, accidentally such as from a spill, or intentionally, is shown in FIGS. 8A through 10B. Such prevention of fluid at a threshold is desirable to prevent water damage to the unwaterproofed area, eg the hallway, and any construction thereunder, including ceilings, and floorings and similar in the floor below.

Figure 8A:
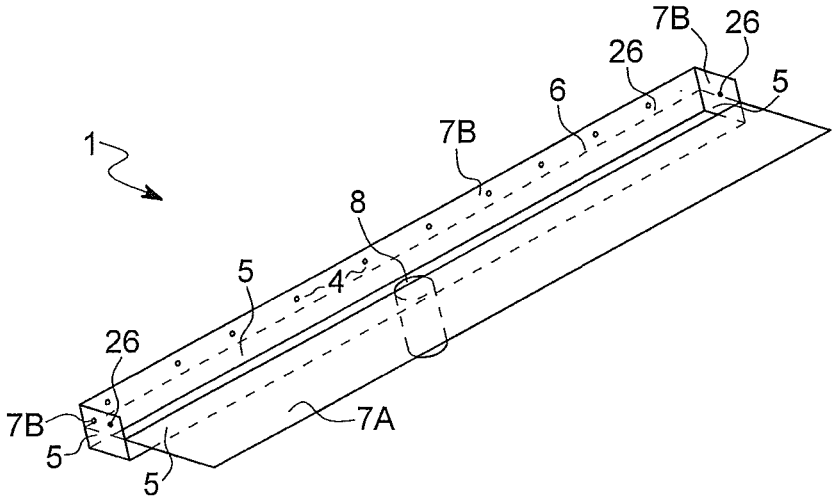
FIG. 8 shows at 8A and 8B a further embodiment for use at or near a threshold, for example near or under a door between a wet space and a dry space in plan isometric view, where 8A has no outward flange on the dry space side, and 8B has an outward flange on the dry space side.
Figure 8B:
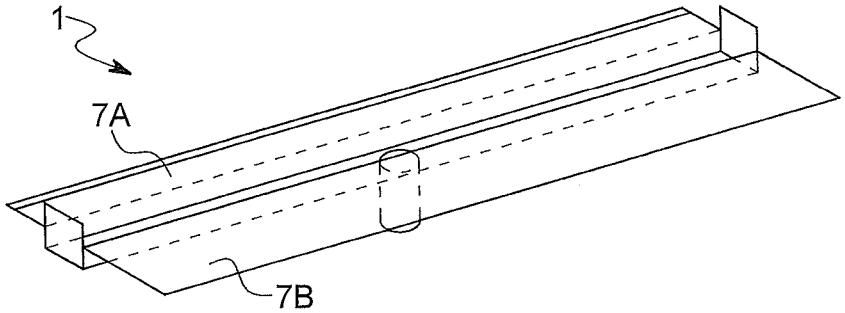
Figure 9A:
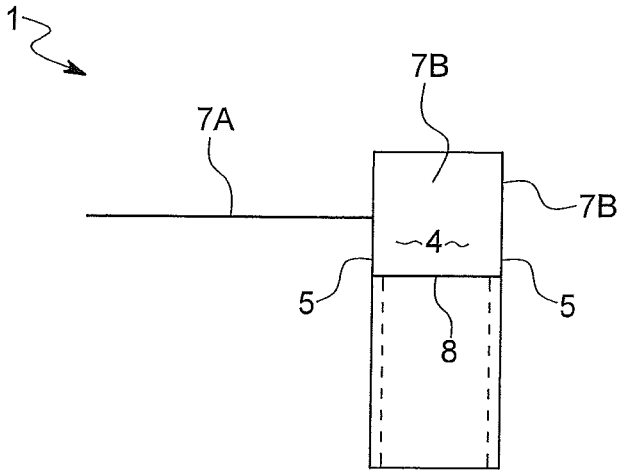
FIG. 9 shows at 9A and 9B a vertical cross-section through the embodiment of FIGS. 8A and 8B respectively.
Figure 9B:
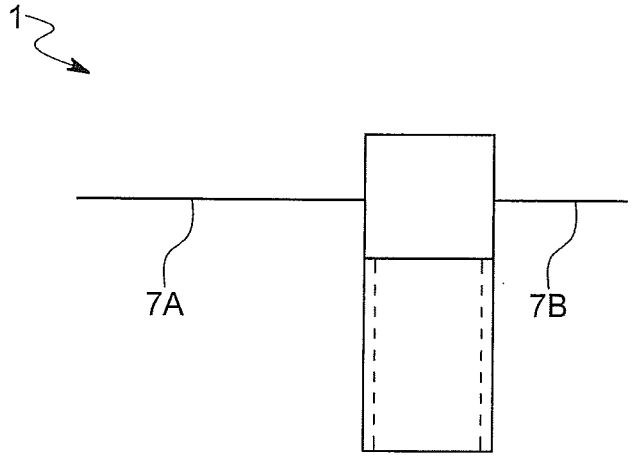

The channel 4 shown in FIGS. 8A, 8B and 9A, 9B has a floor portion 25 surrounded by sides 5 to define a periphery 6 and the channel 4. Extending upwardly from the periphery 6 from each of three sides 5 is an upward planar flange 7B as shown in FIG. 8A. These upward planar flanges as they are adjacent, are joined. In addition there is an outward planar flange 7A on one side 5. A further variation, which is the preferred form, is shown in FIGS. 8B, 9B and 10B where the dry space side 22 has an outward flange 7B which is fastened to upper presenting surface of the flooring on the dry space side 22, and then the finishing 12 is applied over that flange 7B. This could be installed under a door, but also could be adjacent a door also. Present also is an upward flange 7B along the hallway (or similar) side of the channel 1. This is of a height equal of less than the final floor 2 finish height of the finishing 12. This will prevent fluid that spills from the side of the bathroom, laundry or kitchen 20 from flowing into the hallway 22 (or similar) and finishing 12 there.

In the preferred form the planar flanges 7A and 7B have fastener holes 26.

Figure 10A:
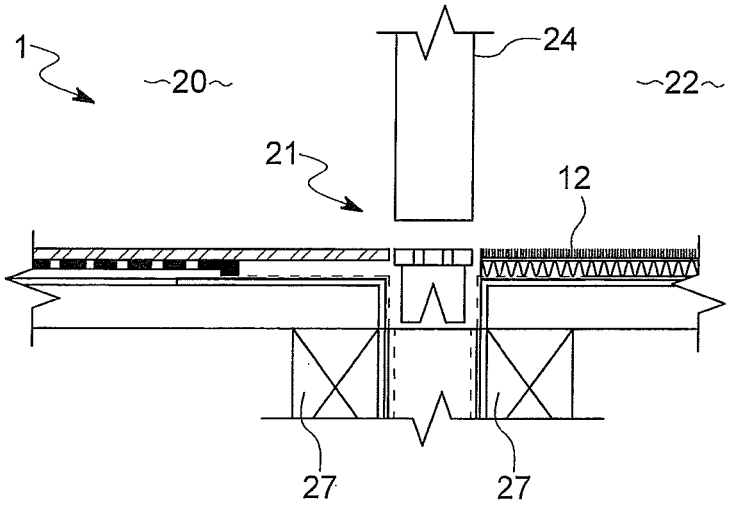
FIG. 10 shows at 10A and 10B a vertical cross-section of the installed embodiment of FIGS. 8A and 8B respectively showing the floor and support members.
Figure 10B:
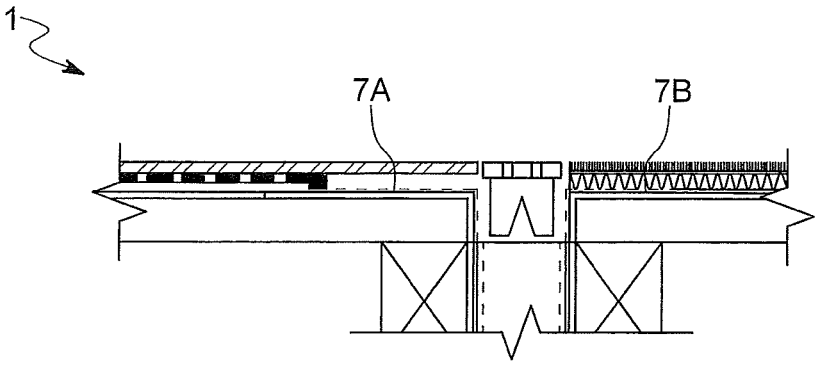

The general installation of the drainage channel 1 is shown in FIG. 10A as a threshold channel, in this example the drainage channel is located in a floor of a room, for example a wet room, such as a bathroom/laundry/kitchen 20 at the threshold 21 of that room to, for example a hallway 22. The purpose of the drainage channel 1 here is to prevent egress of fluid from the room 20 to the hallway 22 (or similar). The need here is that typically a wet room 20 will have water proofing around it and so fluid in that room will not flood out through the floor or similar. However the hallway 22 or similar, does not have any waterproofing. Therefore fluid that finds its way from the room 20, across the threshold 21, to the hallway 22 (or similar) can then seep through the floor of the hallway 22 (or similar). This poses a risk where for example the wet room 20 and the hallway 22 (or similar) are on a second story, and fluid otherwise may seep down and damage the building or rooms underneath that second story.

An aperture 13 is shown cut into a building floor 2. The building floor 2 is supported in the normal way for a building as shown using framing 27. The channel 1 is lowered into place in the aperture 13.

If desired the installer may add waterproofing, adhesive or sealant to the underside of the planar flanges 7 to seal against for example the sides or other surfaces of the aperture 13.

Penetrative fasteners are then driven through the planar flanges 7 into the substrate below. In the embodiment shown for outward planar flanges 7A the fasteners are driven into the building floor 2 (and framing 27 there under). In the preferred form framing 27 is provided at the periphery of the aperture to support the floor 2 and wall 15, and also to receive the penetrative fastenings from the planar flanges 7. Penetrative fastenings 18 are also driven through the upward planar flanges 7B into the surrounding framing.

Once secured in this way there is no need for further support for the channel 1 from underneath, the planar flanges and structural rigidity due to its elongate box form is sufficient to take all in use loading for the channel. Again predrilled holes, or indicated locations for them, may be present, as described above to show the required fastenings to securely hold the channel and prevent rupture of the waterproof envelope.

Normally a tiling underlay 28 is located in place in the wet room 20 side. The installer than can install waterproofing 17 across the floor 2 and over the underlay 28 and outward planar flange 7A as shown. In the preferred form the waterproofing 17 extends at least in part down the sides 5 into the channel 4.

A finishing 12 can then be applied for example tiles or similar in the wet room 20. The finishing 12 on the floor extends up to the edge of the channel 4 as shown.

A grate with grate apertures 29 therein is then located in the channel 2. The grate has upstands 10 along its length that rest on the lowermost floor portion 25. The upstands can be adjusted in height, either by a threaded connection, or simply cutting them to length. The desired length is set so the upper surface 11 of the grate is substantially flush with the upper level of the floor finishing 12.

At any point during this procedure, but preferably as the channel 1 is initially located in the aperture 13 the waste outlet 3 is connected to the waste aperture 8.

Finishing 12 in the hallway 22 (or similar) can be installed at any time also.

The result is that fluid, for example water from a shower or basin that overflows in the wet room 20, can then flow over the floor finishing into the channel 1 and then be taken away by the waste aperture 8 to the waste outlet 3 before it egresses over the threshold 21 into the hallway 22. The channel 1 does not need any framing made under it to support it.

Figure 11:
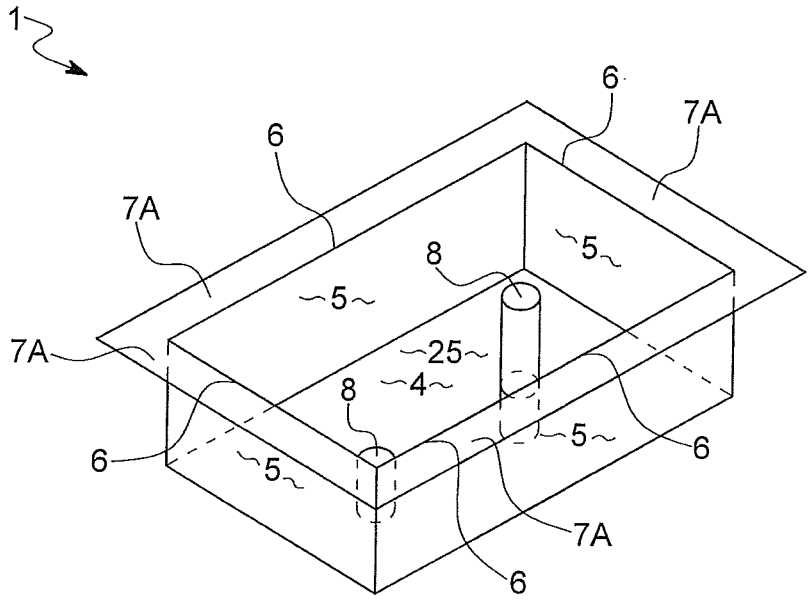
FIG. 11 shows and plan isometric view a further embodiment for use as a trap for drainage on a deck.
Figure 12:
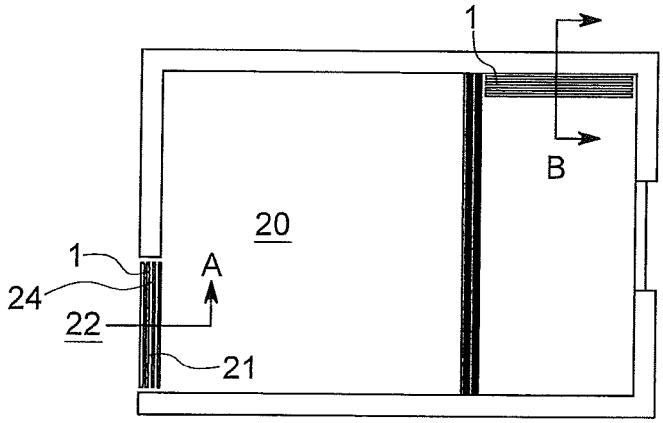
FIG. 12 shows a plan view of a wet area, in this example a bathroom showing the location of the drainage channel in a shower and also across the threshold between the wet area or potential flood area of the bathroom and the dry area such as for example a hallway.
Figure 13:
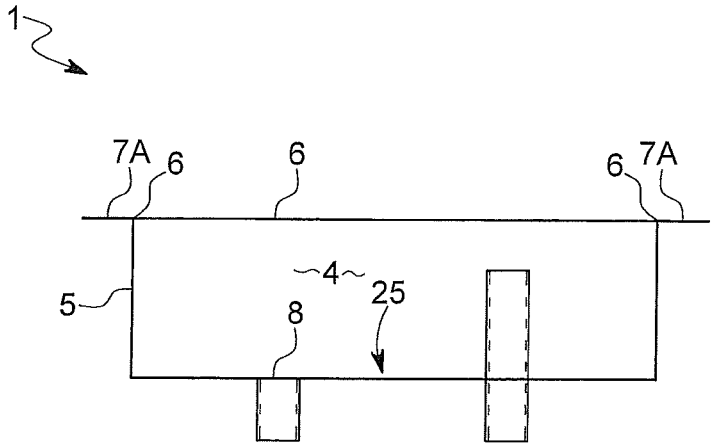
FIG. 13 shows a vertical cross-section of the embodiment of FIG. 11.
Figure 14:
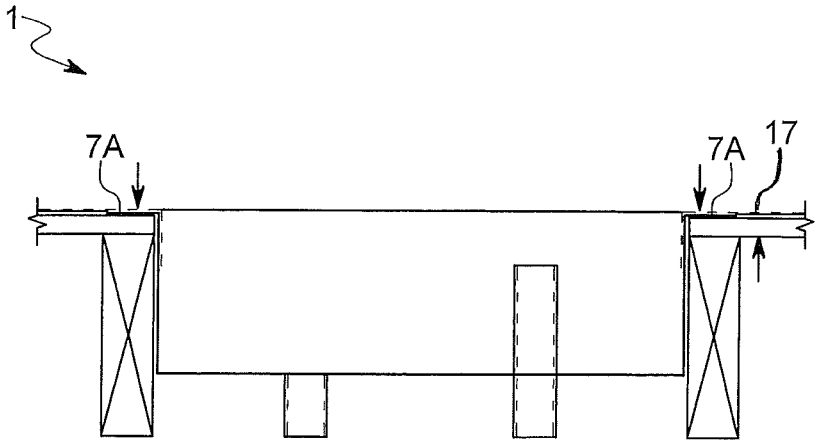
FIG. 14 shows a cross-section of the embodiment of FIG. 11 installed in a floor structure, for example a deck, showing the support and flooring and sealing components.

A fourth embodiment of the drainage channel is shown in FIGS. 11, 13, and 14 for a deck or similar area. This is installed in a similar way to that of the second embodiment, but the floor in this instance is a deck.

Figure 15:
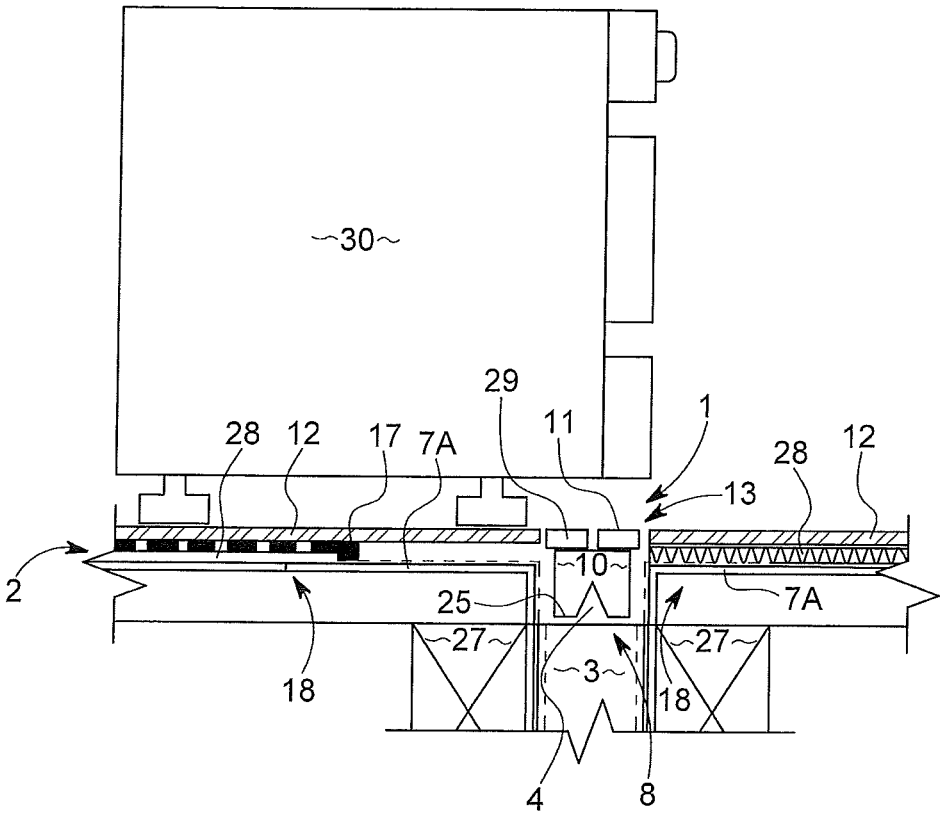
FIG. 15 shows a side view in cross section through a building floor showing the channel mounted as a containment to prevent spilled fluids from an appliance moving further on the building floor, the appliance could be a dishwasher, washing machine or any similar unit that uses a fluid that has the potential to leak, where such a leak is not desirable.

A further embodiment is shown in FIG. 15 using a channel 1 to provide a containment for an appliance 30. The channel is used to prevent spread of water or any other fluid that may emanate from the appliance 30, for example if the appliance fails for any reason, or the fluid supply to, or from, is compromised, in essence mitigation of any leaks. The channel is installed in a similar way to channels described earlier. It may be hidden underneath the appliance, or may be located in sight.

The general installation of the drainage channel 1 as a containment is shown in FIG. 15, in this example the drainage channel 1 is located in a floor 2 of a room, for example a kitchen or laundry, under an appliance 30. The purpose of the drainage channel 1 here is to prevent fluid that may leak from the appliance 30 from doing further damage to the floor 2 and any structures below, as well as spreading out along the floor to unprotected walls or similar. The need here is that typically areas where an appliance 30 may be do not always have waterproofing. Therefore fluid that finds its way from the appliance 30, can then spread through or along the floor 2. This poses a risk where for example the appliance is on a second story, and fluid otherwise may seep down and damage the building or rooms underneath that second story, or that may damage structures on the floor the appliance 30 is on, for example unprotected walls and similar.

To install the channel 1 an aperture 13 is shown cut into a building floor 2. The building floor 2 is supported in the normal way for a building as shown using framing 27. The channel 1 is lowered into place in the aperture 13.

If desired the installer may add waterproofing, adhesive or sealant to the underside of the planar flanges 7 to seal against for example the sides or other surfaces of the aperture 13.

Penetrative fasteners are then driven through the planar flanges 7 into the substrate below. In the embodiment shown for outward planar flanges 7A the fasteners are driven into the building floor 2 (and framing 27 there under). In the preferred form framing 27 is provided at the periphery of the aperture to support the floor 2, and also to receive the penetrative fastenings from the planar flanges 7, however no framing is needed under the channel 4 itself. Penetrative fastenings 18 are also driven through the planar flanges 7A (not shown) on the sides of the channel 1.

Once secured in this way there is no need for further support for the channel 1 from underneath, the planar flanges and structural rigidity due to its elongate box form is sufficient to take all in use loading for the channel. Again predrilled holes, or indicated locations for them, may be present, as described above to show the required fastenings to securely hold the channel and prevent rupture of the waterproof envelope.

Normally a tiling underlay 28 is located in place. The installer than can install waterproofing 17 across the floor 2 and over the underlay 28 and outward planar flange 7A as shown. In the preferred form the waterproofing 17 extends at least in part down the sides 5 into the channel 4.

A finishing 12 can then be applied for example tiles or similar to the floor. The finishing 12 on the floor extends up to the edge of the channel 4 as shown on either side.

A grate with grate apertures 29 therein is then located in the channel 2. The grate has upstands 10 along its length that rest on the lowermost floor portion 25. The upstands can be adjusted in height, either by a threaded connection, or simply cutting them to length. The desired length is set so the upper surface 11 of the grate is substantially flush with the upper level of the floor finishing 12.

At any point during this procedure, but preferably as the channel 1 is initially located in the aperture 13 the waste outlet 3 is connected to the waste aperture 8.

The result is that fluid, for example water from a dishwasher 30, can then flow over the floor finishing 12 into the channel 1 and then be taken away by the waste aperture 8 to the waste outlet 3 before it egresses over the floor 2. The channel 1 does not need any framing made under it to support it.

The foregoing description of the invention includes preferred forms thereof. Modifications may be made thereto without departing from the scope of the invention.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A drainage channel adapted to receive fluid from a building floor and drain it to a waste outlet, comprising:

an upwardly open channel having a lower most floor portion and about the floor portion are sides to fluidly enclose and define the channel, on an upper most periphery of the channel a first one of the sides has a substantially planar flange extending outwardly therefrom, and on the upper most periphery a second one of the sides has a substantially planar flange extending outwardly or upwardly therefrom;

a waste aperture in the floor portion to allow draining of the fluid from the channel to the waste outlet when fluidly connected thereto; and a grate supported from the floor portion via upstands unitary with, and extending from, a lower portion of the grate, the upstands locating an upper surface of the grate substantially at a desired height relative an upper surface of a finishing of the building floor;

wherein the channel is substantially located within an aperture in the building floor and the substantially planar flanges extending outwardly are secured to an upper presenting surface of the floor, and the substantially planar flange extending upwardly is secured to an upward surface of a channel surrounding wall, to hold the drainage channel in place;

wherein the planar flanges are secured to the building floor and walls using penetrative fastenings through the planar flanges and into the floor and walls, wherein the drainage channel requires no support from below, it is only secured in place by the planar flanges, such that a drainage channel is located in the building floor for removal of fluid therefrom.

2. A drainage channel as claimed in claim 1 wherein any necessary waterproofing and floor finishing is located over the top of the planar flanges.

3. A drainage channel as claimed in claim 2 wherein the waterproofing extends from the planar flanges at least in part down into the channel.

4. A drainage channel as claimed in claim 1 wherein the drainage channel is formed from a thin walled material, comprising:

a metal sheet folded and formed; or a plastics material, molded or extruded.

5. A drainage channel as claimed in claim 1 wherein the drainage channel has the planar flanges on more than two sides.

6. A drainage channel as claimed in claim 1 wherein each of the sides of the channel has a planar flange extending therefrom.

7. A drainage channel as claimed in claim 1 wherein the planar flanges comprise at least two planar flanges that are adjacent each other and extending outwardly, the at least two planar flanges being joined together.

8. A drainage channel as claimed in claim 1 wherein the planar flanges comprise at least two planar flanges that are adjacent each other and extending upwardly, the at least two planar flanges being joined together.

9. A drainage channel as claimed in claim 1 wherein those sides adjacent a wall have upwardly extending substantially planar flanges.

10. A drainage channel as claimed in claim 1 wherein those sides adjacent a building floor have outwardly extending substantially planar flanges.

11. A drainage channel as claimed in claim 1 wherein said channel is located in a building floor in any one or more of the following locations:

a shower for draining fluid therefrom;

a floor of a bathroom, laundry or kitchen or similar for draining spilled or cleaning fluids therefrom; or at or near a threshold between a first area (such as a bathroom, laundry or kitchen and a hallway or similar potential source of fluid) for draining of fluid that may be spilt in that area to prevent that fluid moving into a second area.

12. A drainage channel as claimed in claim 1 wherein the channel comprises a channel length and the aperture comprises an aperture length, the channel length being substantially equal to the aperture length.

13. A drainage channel as claimed in claim 1 wherein the upstands are adjustable to provide for a configurable height of the grate with respect to the upper surface of the floor.

14. A drainage channel as claimed in claim 1 wherein the first one of the sides and the second one of the sides are parallel and opposed to each other.

15. A method of installing or providing a drainage channel adapted to receive fluid from a building floor and drain it to a waste outlet, comprising the steps of:

providing an upwardly open channel having a lower most floor portion and about the floor portion are sides to fluidly enclose and define the channel, on an upper most periphery of the channel a first one of the sides has a substantially planar flange extending outwardly therefrom, and on the upper most periphery a second one of the sides has a substantially planar flange extending outwardly or upwardly therefrom, and a waste aperture in the floor portion to allow draining of the fluid from the channel to the waste outlet when fluidly connected thereto;

locating the channel into an aperture in the building floor and securing the planar flanges to an upper presenting surface of the floor, and/or surrounding wall, to hold the drainage channel in place, and the drainage channel requires no support from below, it is only secured in place by the planar flanges;

fluidly connecting the waste aperture to a waste outlet of the building; applying waterproofing at least to the building floor over the planar flanges and at least in part down into the channel;

securing the planar flanges to the building floor and/or walls respectively using penetrative fastenings through the planar flanges and into the floor and/or walls, such that the drainage channel requires no support from below, it is only secured in place by the planar flanges, laying a building floor finishing at least to an upper periphery of the channel;

locating a grate into the channel, the grate being supported from the floor portion via upstands unitary with, and extending from, a lower portion of the grate; and adjusting the grate height via a height of the upstands to have an upper surface of the grate substantially at a desired height relative an upper surface of a finishing of the building floor;

such that a drainage channel can be located in the building floor for removal of fluid therefrom to the waste outlet.

16. A method as claimed in claim 15 wherein a finishing on a surrounding wall extends down past the periphery of the channel.

17. A kit of parts for a drainage channel adapted to receive fluid from a building floor and drain it to a waste outlet, comprising:

an upwardly open channel having a lower most floor portion and about the floor portion are sides to fluidly enclose and define the channel, on an upper most periphery of the channel a first one of the sides has a substantially planar flange extending outwardly therefrom, and on the upper most periphery a second one of the sides has a substantially planar flange extending outwardly or upwardly therefrom;

a waste aperture in the floor portion to allow draining of the fluid from the channel to the waste outlet when fluidly connected thereto; and a grate able to be supported from the floor portion via upstands unitary with, and extending from, a lower portion of the grate, the grate able to be adjusted in height via a height of the upstands to have an upper surface of the grate substantially at a desired height relative an upper surface of a finishing of the building floor;

wherein the channel is substantially located within an aperture in the building floor and the substantially planar flanges extending outwardly is secured to an upper presenting surface of the floor, and the substantially planar flange extending upwardly is secured to an upward surface of a channel surrounding wall, to hold the drainage channel in place, and the drainage channel requires no support from below, it is only secured in place by the planar flanges, wherein the planar flanges are securable to the building floor and walls using penetrative fastenings through the planar flanges and into the floor and walls, wherein the drainage channel when installed requires no support from below, it is only secured in place by the planar flanges, such that a drainage channel is located in the building floor for removal of fluid therefrom.

* * * * *